US006310022B1

(12) United States Patent
Amiran

(10) Patent No.: US 6,310,022 B1
(45) Date of Patent: Oct. 30, 2001

(54) CHEMICAL CLEANING SOLUTION FOR GAS TURBINE BLADES

(75) Inventor: Mohsen C. Amiran, Des Plaines, IL (US)

(73) Assignee: BioGenesis Enterprises, Inc., Springfield, VA (US)

( * ) Notice: Subject to any disclaimer, the term of this patent is extended or adjusted under 35 U.S.C. 154(b) by 0 days.

(21) Appl. No.: 09/725,489

(22) Filed: Nov. 30, 2000

Related U.S. Application Data

(60) Provisional application No. 60/167,907, filed on Nov. 30, 1999.

(51) Int. Cl.[7] ..... C11D 1/66; C11D 1/825

(52) U.S. Cl. ..... 510/185; 134/2; 134/3; 252/175; 510/245; 510/254; 510/401; 510/477; 510/506

(58) Field of Search ..... 510/175, 253, 510/254, 365, 245, 185, 401, 477, 506; 514/566; 252/180, 175; 134/3, 4, 2

(56) References Cited

U.S. PATENT DOCUMENTS 4,430,234 * 2/1984 Hasegawa et al. ..... 252/49.5
5,346,556 * 9/1994 Perry et al. ..... 134/2

FOREIGN PATENT DOCUMENTS

1344814-A * 10/1987 (SU) .

* cited by examiner

*Primary Examiner*—Yogendra N. Gupta
*Assistant Examiner*—Gregory E. Webb
(74) *Attorney, Agent, or Firm*—Birch, Stewart, Kolasch & Birch, LLP

(57) ABSTRACT

The invention is directed to a chemical cleaning composition containing a hydroxylated wetting agent, a chelating agent, an emulsifier, optionally a crown ether, and optionally a non-aromatic solvent. The cleaning composition is 100% biodegradable, water-based, and able to remove adhered particles having a particle size of less than 35 micrometers. The invention also relates to a process for cleaning a substrate such as a gas turbine engine.

25 Claims, 4 Drawing Sheets

BEFORE CLEANING

AFTER CLEANING

BEFORE CLEANING

AFTER CLEANING

CHEMICAL CLEANING SOLUTION FOR GAS TURBINE BLADES

This application claim benefit of Provisional Application No. 60/167,907 filed Nov. 30, 1999.

BACKGROUND OF THE INVENTION

1. Field of the Invention

The present invention relates to a chemical cleaning solution for gas turbine blades. In particular, the present invention relates to a cleaning composition comprising a hydroxylated wetting agent, a chelating agent, an emulsifier, an optional crown ether, and an optional non-aromatic solvent.

2. Description of the Prior Art

Industrial gas turbine engines are used worldwide. An example of a gas turbine is a Mars Gas Turbine or a Taurus 70 Gas Turbine, manufactured by Solar Turbines, Inc. A Mars turbine has a 15 stage compressor and each stage is comprised of a stationary row of blades (stator blades) and a rotating row of blades. The blades are the largest at stage 1 and the smallest at stage 15. During operation, air is drawn into the compressor's divergent passage and compressed through every stage.

The stator blades direct the compressed air at each stage across its companion row of rotating blades. The air foil of the stator and rotating blades have been designed for maximum efficiency. However, as a result of continuous operation, contaminants build up on the leading edge of these air foils. Consequently, overall efficiency is lost in the compressor section. This in turn reduces the horsepower available for consumer use. The Mars turbine engine compresses approximately 90 pounds per second of air at full rated horsepower. There is only a small amount of airborne contaminants per standard cubic foot of air. However, with the massive amounts of air passing through the turbine these contaminants are multiplied. Moreover, the air enters the turbine at room temperature and leaves the compressor at approximately 630° F. Most of the lost efficiency is across the first three or four stages and it is very difficult to clean the blades once the contaminants have adhered to them.

Accordingly, gas turbines must be cleaned, usually monthly, to maintain operating efficiency and maximum available horsepower. There exists two main ways to clean a gas turbine. One of these is crank washing and the other is on-line washing. Crank washing is the more common of the two. During cleaning, each turbine uses about 2 gallons of cleaner to clean the turbine and an additional 1–2 gallons to clean the package. The same cleaner may also be used for general cleaning purposes in the operating plant. Accordingly, there exists a large need for a superior gas turbine cleaner.

Gas turbine crank washing is a method whereby a cleaning solution is introduced into the turbine compressor inlet of a turbine while slow cranking. This slow cranking occurs cold without ignition or fuel being introduced. There are many types of turbine compressor cleaners on the market. These include Penetone® 19, by Penetone Corporation; Connect® 5000, by Conntect, Inc.; Turco® 6783 Series, by Turco Products, Inc.; ZOK® 27, by ZOK Incorporated; and Fyrewash®, by Rochem Corporation.

However, current cleaning products have several disadvantages. These disadvantages include excessive foaming, extended soaking periods, low water solubility, residual cleaner, failure to remove adhered particles of less than 35 micrometers, and the absence of a 100% biodegradable. Current products cure some of these disadvantages; however, none have been able to cure all of these properties. Of importance in view of current trends of environmental safety is a product that is 100% biodegradable. Current products are biodegradable but none are 100% biodegradable. Moreover, current water-based products are not capable of removing adhered particles having a particle size of less than 35 micrometers. These types of particles cannot be removed unless some type of solvent-based chemical is used. Thus, there is no cleaning solution which is water-based and can remove particles less than 35 micrometers.

SUMMARY OF THE INVENTION

Accordingly, the present invention is directed to a gas turbine cleaner which cures all of the above disadvantages including being 100% biodegradable, water-based, and able to remove adhered particles having a particle size of less than 35 micrometers.

In one embodiment, the present invention relates to a composition comprising a hydroxylated wetting agent, a chelating agent, an emulsifier, and a crown ether. In an embodiment of the present invention, the present composition comprises (1) about 10% to about 60%, preferably about 30% to about 50%, more preferably about 38% to about 42% by weight of the hydroxylated wetting agent, (2) about 20% to about 40%, preferably about 25% to about 35%, more preferably about 29% to about 31% by weight of the chelating agent, (3) about 1% to about 45%, preferably about 15% to about 35%, more preferably about 20% to about 30% by weight of the emulsifier, and (4) about 0.01% to about 2%, preferably about 0.05% to about 1.25%, more preferably about 0.5% to about 1% by weight of the crown ether. Each of these % by weight values are based on the total weight of the composition.

In another embodiment of the present invention, the present composition comprises a hydroxylated wetting agent, a chelating agent, and an emulsifier. A crown ether is absent from this embodiment of the present invention.

In another embodiment, the present composition comprises a hydroxylated wetting agent, a chelating agent, an emulsifier, a crown ether, and a non-aromatic solvent. In this embodiment the present composition comprises (1) about 10% to about 60%, preferably about 30% to about 50%, more preferably about 38% to about 42% by weight of the hydroxylated wetting agent, (2) about 1% to about 30%, preferably about 15% to about 25%, more preferably about 19% to about 21% by weight of the chelating agent, (3) about 1% to about 45%, preferably about 15% to about 35%, more preferably about 20% to about 30% by weight of the emulsifier, (4) about 0.01% to about 2%, preferably about 0.05% to about 1.25%, more preferably about 0.5% to about 1% by weight of the crown ether, and (5) about 1% to about 20%, preferably about 5% to about 15%, more preferably about 9% to about 11% of the non-aromatic solvent. Each of these % by weight values are based on the total weight of the composition.

In yet another embodiment, the present composition comprises a hydroxylated wetting agent, a chelating agent, an emulsifier, and a non-aromatic solvent. A crown ether is absent from this embodiment of the present invention.

In one embodiment, the hydroxylated wetting agent of the present invention is a hydroxylated hydrocarbon containing 2 to 6 carbon atoms and 2 to 4 hydroxyl groups. In particular, the ratio of the carbon atoms to the hydroxyl groups is between 1.0 and 0.75. In a preferred embodiment, the hydroxylated wetting agent is one or more of polypropyleneglycol, polyethyleneglycol, glycerine, ethylene glycol, or propylene glycol.

In another embodiment, the chelating agent is EDTA and the emulsifier is a non-ionic surfactant.

In an embodiment of the present invention, the crown ether is a $C_8$–$C_{30}$ crown ether, preferably a $C_{10}$–$C_{20}$ crown ether, and more preferably a $C_{13}$–$C_{19}$ crown ether.

In yet another embodiment, the non-aromatic solvent is a linear or non-linear alcohol having 1 to 6 carbons and from 1 to 5 ethoxylations; a mono-, di-, or tri-ester of mono-, di-, or tri-carboxylic acid; or a mono-, di-, or tri-alkyl ester. Specific examples include methyl ester, ethyl ester, ethyl acetate, methyl laurate, dimethyl citric acid, ethyl propionate, lauryl acetate, methyl glutamate, diethoxy-2-ethyl propyl alcohol, diethoxy pentyl alcohol, triethoxy pentyl alcohol, and diethoxylated isobutyl alcohol. In a preferred embodiment, the non-aromatic solvent is an ethoxylated non-linear alcohol such as di-ethoxylated isobutyl alcohol, $C_8H_{19}O_2$, or an organic ester such as methyl laurate.

The present composition may also optionally contain a water-soluble organic solvent and a non-silicon based anti-foam agent. The water-soluble organic solvent may be isopropanol and the anti-foam agent may be an ethoxylated linear alcohol. The present invention further provides for a process for cleaning a substrate such as a gas turbine. This process includes providing a cleaning composition according to the present invention and contacting that cleaning solution with the substrate to be cleaned. The amount of time that the cleaning composition and the substrate are contacted depends upon the degree of cleaning desired. In other words, the more fouled the substrate, the longer the contact time.

BRIEF DESCRIPTION OF THE DRAWINGS

The present invention will become more fully understood from the detailed description given hereinbelow, and the accompanying drawings that are given by way of illustration only and thus are not limitive of the present invention, and wherein.

DETAILED DESCRIPTION OF THE INVENTION

Figure 1:
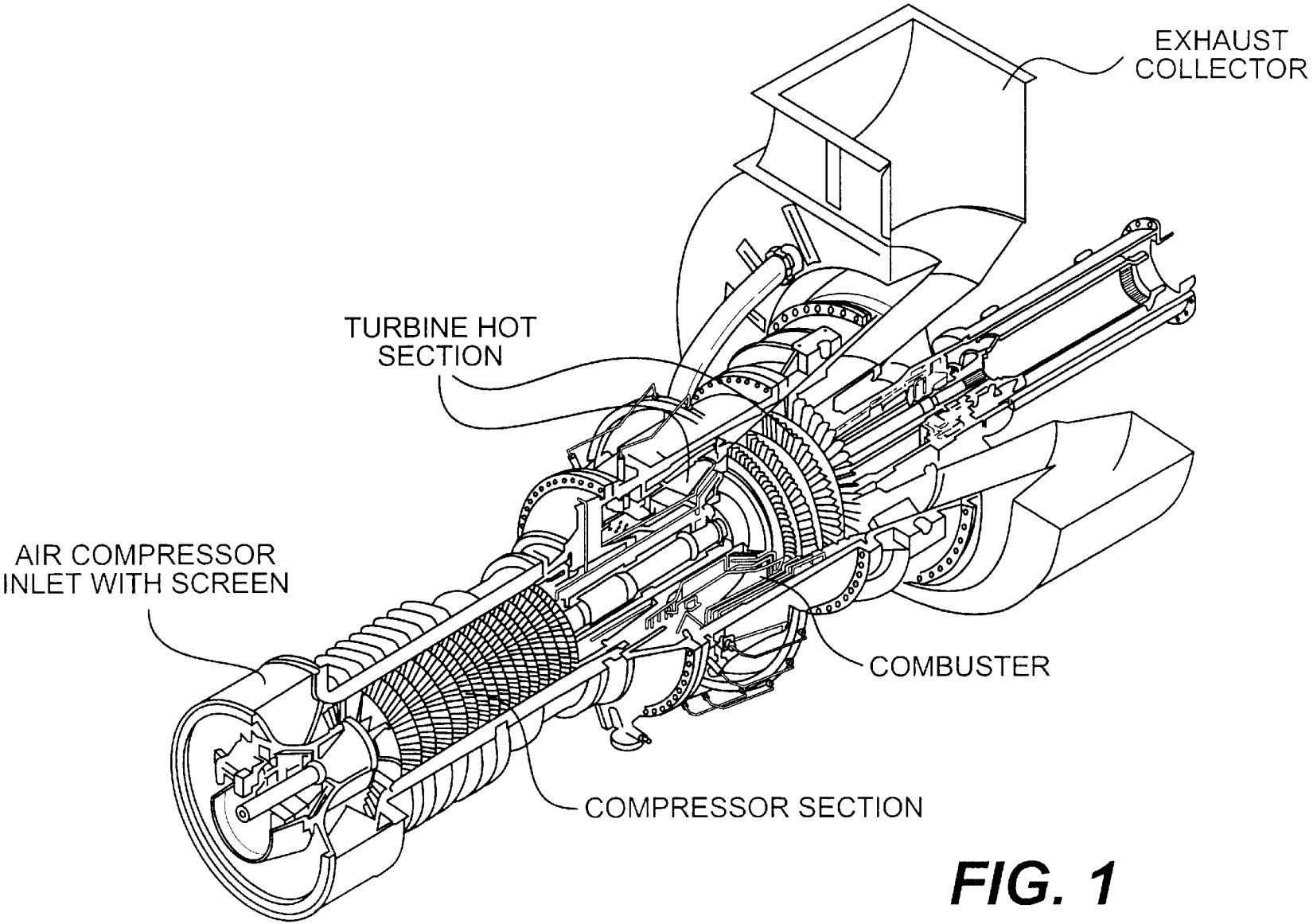
FIG. 1 is a Mars Gas Turbine produced by Solar® Turbines.
Figure 2:
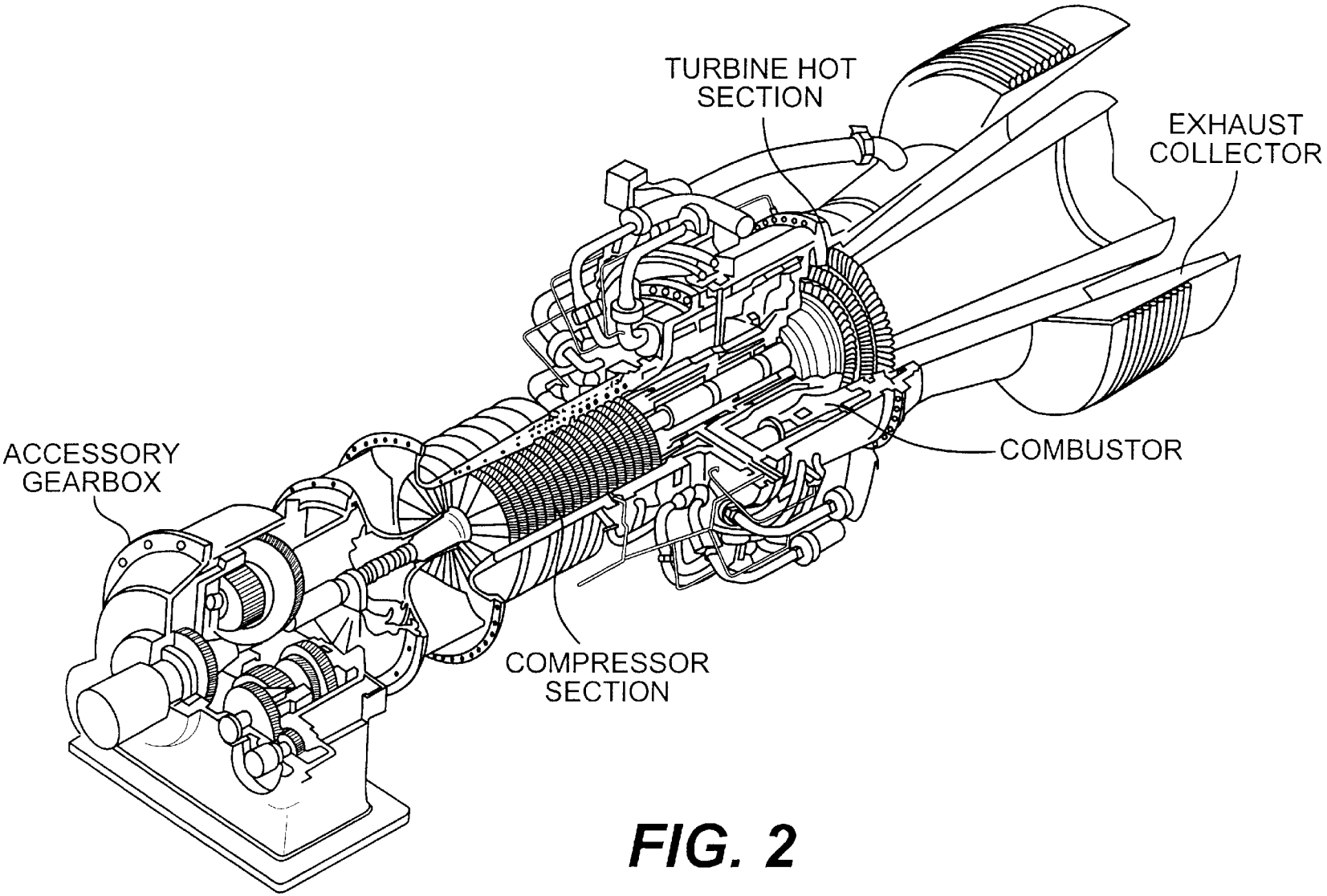
FIG. 2 is a Taurus 70 Gas Turbine by Solar® Turbines.
Figure 3A:
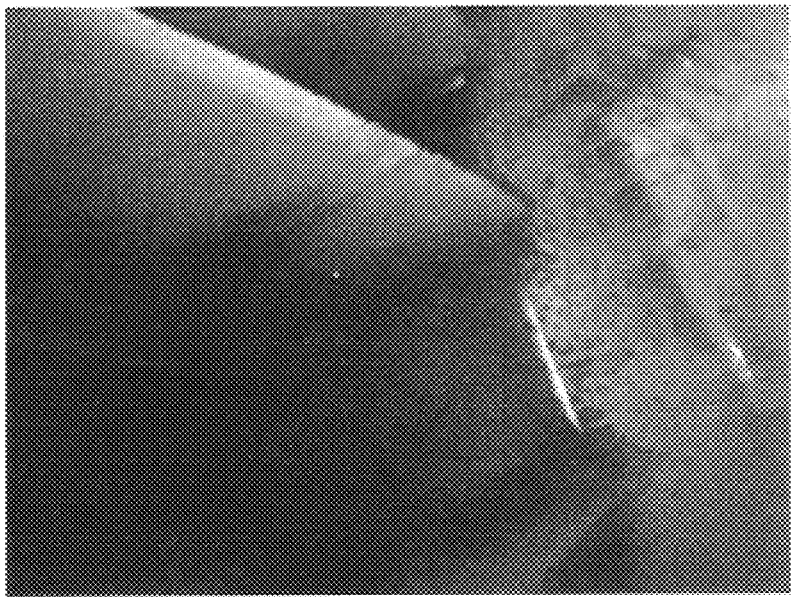
FIG. 3A is a picture of a turbine before cleaning with the present cleaner and FIG. 3B is a picture of the same turbine after cleaning with the present cleaner.
Figure 3B:
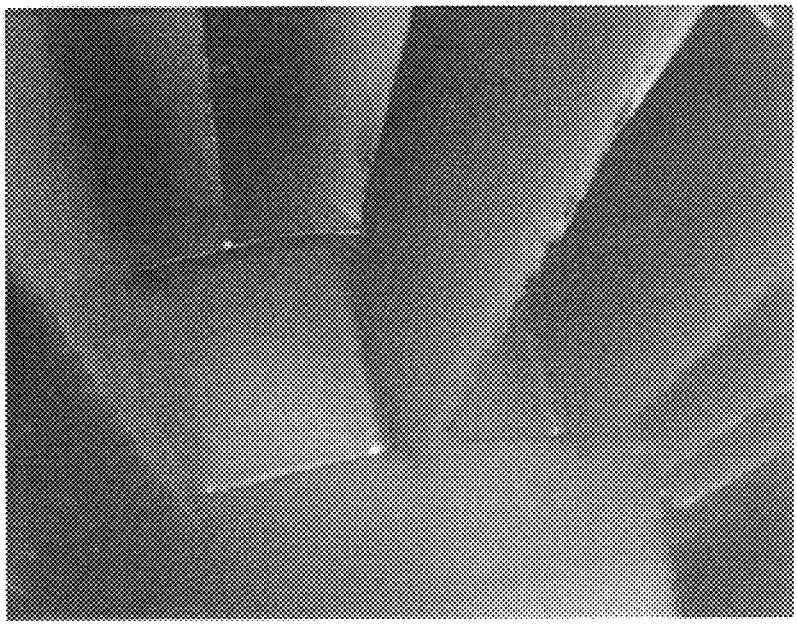
Figure 4A:
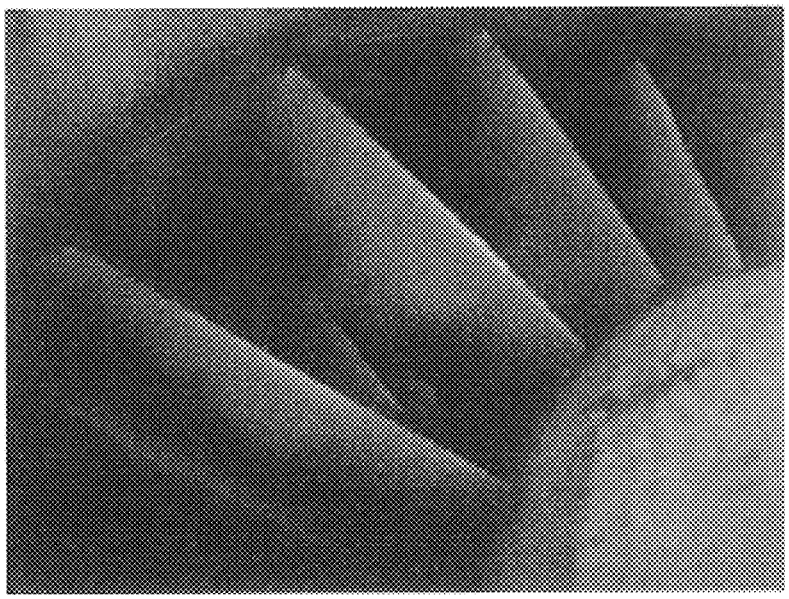
FIG. 4A is a picture of a turbine before cleaning with the present cleaner and FIG. 4B is a picture of the same turbine after cleaning with the present cleaner.
Figure 4B:
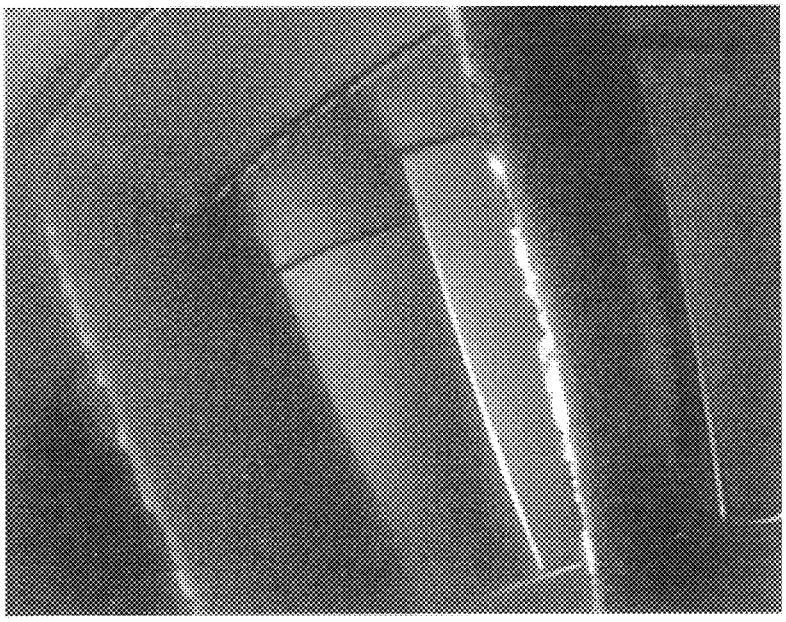

The present invention is directed to a gas turbine cleaner. In particular, the cleaner of the present invention is described as a composition. The present composition is 100% biodegradable, water-based, and able to remove particles less than 35 micrometers. The composition of the present invention comprises a hydroxylated wetting agent, a chelating agent, an emulsifier, and optionally, a crown ether. The present composition may also contain additives.

The present invention is also directed to a process for cleaning a substrate comprising providing a cleaning solution according to the present invention and contacting the cleaning solution with the substrate to be cleaned.

The present invention will now be further described by separately describing each of its components.

A. The Cleaning Solution

1. Hydroxylated Wetting Agent

The hydroxylated wetting agent of the present invention acts as a penetrating agent to loosen the organic phase of particles adhering to the surface of the turbine blades. According to the present invention, the hydroxylated wetting agent is a hydroxylated hydrocarbon or a combination of hydroxylated hydrocarbons. Individually, the hydroxylated -hydrocarbon preferably contains 2–6 carbon atoms and 2–4 hydroxyl groups. The ratio of hydroxyl groups to carbon atoms in an individual hydroxylated hydrocarbon is preferably between 1.0–0.75.

Specific but non-limitive examples of the hydroxylated hydrocarbon include polypropyleneglycol, polyethyleneglycol, glycerine, ethylene glycol, and propylene glycol.

The hydroxylated wetting agent according to the present invention is present in an amount of about 10 to about 60% by weight, preferably about 30 to about 50% by weight, and more preferably about 38 to about 42% by weight, based on the total weight of the composition. The hydroxylated wetting agent is most preferably present in an amount of about 40% by weight based on the total weight of the composition. The percent (%) by weight amounts for the hydroxylated wetting agent are based on a 100% stock solution of hydroxylated wetting agent.

2. Chelating Agent

The chelating agent of the present invention acts to dissolve inorganic oxides. According to the present invention, the chelating agent is a chelating compound such as ethylenediaminetetraacetic acid (EDTA) or EDTA derivatives including mono-, di-, tri-, or tetra-sodium EDTA, mono-, di-, tri-, or tetra-ammonium and the like. Other chelating agents include nitrilotriacetic acid (NTA) or NTA derivatives; or diethylenetriaminepentaacetic acid (DTPA) or DTPA derivatives.

The chelating agent according to the present invention is present in an amount of about 20 to about 40% by weight, preferably about 25 to about 35% by weight, and more preferably about 29 to about 31% by weight, based on the total weight of the composition. The chelating agent is most preferably present in an amount of about 30% by weight based on the total weight of the composition.

When a non-aromatic solvent is added to the composition of the present invention, the amounts of chelating agent may be modified. For example, the amount of chelating agent used is changed to about 1% to about 30%, preferably about 15% to about 25%, and more preferably about 19% to about 21% by weight based on the total weight of the composition.

The percent (%) by weight amounts for the chelating agent are based on a 60% stock solution of chelating agent.

3. Emulsifier

The emulsifier of the present invention acts to suspend larger organic molecules such as grease. According to the present invention, the emulsifier may be any surfactant but is preferably an anionic surfactant. The most preferred surfactant is a non-ionic surfactant while the least preferred surfactant is a cationic surfactant. Any linear alcohol having an HLP of between about 5 to about 10 is suitable; however, of particular suitability is an ethoxylated linear alcohol.

Specific but non-limitive examples of surfactants include TWEEN® 20 and Poly-Tergent® SL-62, by BASF.

The surfactant according to the present invention is present in an amount of about 1 to about 45% by weight, preferably about 15 to about 35% by weight, and more preferably about 20 to about 30% by weight, based on the total weight of the composition. The surfactant is most preferably present in an amount of about 25% by weight based on the total weight of the composition. The percent (%) by weight amounts for the surfactant are based on a 100% stock solution of surfactant.

4. Crown Ether

The crown ether of the present invention binds strongly with fine particles having a particle size of less than 35 micrometers. This is accomplished by binding the fine particles with a strong negative charge from multiple angles. However, if the object to be cleaned lacks a significant amount of particles of this size, the crown ether may optionally be omitted from the cleaning solution. According to the present invention, the crown ether contains about 8 to about 30 carbon atoms, i.e., a $C_8$–$C_{30}$ crown ether; preferably about 10 to about 20 carbon atoms, i.e., a $C_{10}$–$C_{20}$ crown ether; and more preferably about 13 to about 19 carbon atoms, i.e., a $C_{13}$–$C_{19}$ crown ether. The crown ether is most preferably a $C_{16}$ crown ether.

When present, the crown ether according to the present invention is present in an amount of about 0.01 to about 2% by weight, preferably about 0.05 to about 1.25% by weight, and more preferably about 0.5 to about 1% by weight, based on the total, weight of the composition. The crown ether is most preferably present in an amount of about 0.75% by weight based on the total weight of the composition. The percent (%) by weight amounts for the crown ether are based on a 100% stock solution of crown ether.

5. Non-aromatic Solvent

The optional non-aromatic solvent of the present invention works to soften hydrocarbon material that is baked onto the turbine blades. The non-aromatic solvent may have characteristics to being hydrophobic and non-reactive. According to the present invention, the non-aromatic solvent is a linear or non-linear alcohol having 1 to 6 carbons and from 1 to 5 ethoxylations; a mono-, di-, or tri-ester of mono-, di-, or tri-carboxylic acid; or a mono-, di-, or tri-alkyl ester. Specific examples include, but are not limited to methyl ester, ethyl ester, ethyl acetate, methyl laurate, dimethyl citric acid, ethyl propionate, lauryl acetate, methyl glutamate, diethoxy-2-ethyl propyl alcohol, diethoxy pentyl alcohol, triethoxy pentyl alcohol, and diethoxylated isobutyl alcohol. In a preferred embodiment, the non-aromatic solvent is an ethoxylated non-linear alcohol such as di-ethoxylated isobutyl alcohol, $C_8H_{19}O_2$, or an organic ester such as methyl laurate CAS 111-82-0 by Henkel®, (Emery 2270 Methyl Laurate).

When present, the non-aromatic solvent according to the present invention is present in an amount of about 1 to about 20% by weight, preferably about 5 to about 15% by weight, and more preferably about 9 to about 11% by weight, based on the total weight of the composition. The non-aromatic solvent is most preferably present in an amount of about 10% by weight based on the total weight of the composition.

6. Additives

The addition of additives is not particularly limited, however, in some instances, it may be desired to add certain additives to the present cleaning composition. These additives include, but are not limited to, water-soluble organic solvents such as isopropanol, and non-silicon based anti-foam agents such as ethoxylated linear alcohols.

The amounts of additives which may be added to the present cleaning composition may vary depending upon the intended use of the cleaning composition. However, the total amounts of additives is about 5% by weight of the total weight of the cleaning composition. In particular, the water soluble organic solvent is preferably added in an amount about 3% by weight of the total weight of the composition and the anti-foam agent is preferably added in an amount of about 2% by weight of the total weight of the composition. Both of these percent (%) by weight values are based upon 100% stock solutions.

B. The Cleaning Process

As mentioned above, there are different methods for cleaning a gas turbine engine. Two of these are crank washing and on-line cleaning.

1. Crank Washing

Crank washing commences with the preparation of the turbine engine. Various drain ports are opened on the turbine to allow the cleaning solution to drain out. There are two air inlet doors that are removed to allow injection of the cleaning solution. The turbine compressor variable guide vanes are moved to the full open position, either manually or electrically.

When the turbine is fully prepped, it is then cranked using the starter motor at approximately 20 to 24% of rated speed. The technician will either inject the cleaning solution using a submersible pump in a 5 gallon bucket of mixed solution or have a pressurized vessel of solution forcing the cleaner through a distribution manifold with nozzles directed into the turbine compressor. The turbine compressor draws the cleaning solution in through the entire compressor. Some of the solution is drawn through the entire engine while the majority drains out the combustor section drain. Depending upon how dirty and fouled the compressor section, two cycles of cleaning wash may be used. The technician will turn off the start motor just before he is out of cleaning solution allowing the solution to be injected as the engine rolls to a stop. The engine is allowed the remain stopped for 10 to 15 minutes allowing the cleaning solution to penetrate before the next crank wash cycle.

After allowing 10 to 15 minutes at rest the engine is rolled up on the starter again and rinsed. De-ionized water is sprayed into the inlet of the compressor and the cleaning solution is rinsed out of the turbine engine drain ports. When the technician believes the solution has been completely rinsed out of the turbine engine the de-ionized water is stopped and the turbine continues to crank to blow the internal section dry. Then the turbine starter is stopped allowing the engine to roll to a stop. The turbine engine systems are then returned to their normal conditions in preparation for a start.

2. On-line Cleaning

On-line turbine compressor cleaning differs from crank washing. Specifically, during on-line compressor cleaning the turbine is running while during crank washing the turbine is merely cranked. During on-line cleaning, the cleaning solution is injected through very small orifices creating a fine mist at the mouth of the turbine compressor. Droplet size is small enough not to cause any damage to the blades. Turbine compressors cannot compress liquids, only air. The theory is that there is enough droplets to completely envelop the blades and to carry off the contaminants through the turbine. The contaminants and the cleaning solution will then pass through the combustor section which operates at up to 3200° F. The duration of the injection will depend upon the orifice size, properties of the cleaning solution and degree of contamination.

The following example is provided for a further understanding of the invention, however, the invention is not to be construe d as limited thereto.

EXAMPLES

Example 1

This example is directed to a specific cleaning solution formulation according to the present invention. This cleaning solution is suitable for cleaning low temperature turbines. The identification and amounts of ingredients are as follows:

| Ingredient | Amount (% by weight) |
|---|---|
| Propylene glycol, CAS 57-55-6, by ARCO Chemical Co. | 40% |
| Sequestrene ® tetraammonium EDTA by BASF Corporation. | 30% |
| Policy-Tergent ® SL-62 Surfactant, CAS 68987-81-5 alkoxylated linear alcohol, by BASF Corporation. | 15% |
| Tween ® 20 (polysorbate 20), polyoxyethylene (20) Sorbitan monolaurate, CAS 9005-64-5, by ICI Americas, Inc. | 10% |
| Isopropyl alcohol, CAS 67-63-0, by Exxon, Shell, Union Carbide or BP Chemicals. | 3% |
| Anti-foam Emulsion 7305, non-silicon base by Ashland Chemical Co. | 2% |
| Total | 100% |

The above formulation is prepared by mixing each of the ingredients in a vessel. The size of the vessel depends upon the amount of cleaning solution desired.

Example 2

This example is directed to a specific cleaning solution formulation according to the present invention. This cleaning solution is suitable for cleaning jet engines or other high temperature turbines. The identification and amounts of ingredients are as follows:

| Ingredient | Amount (% by weight) |
|---|---|
| Propylene glycol, CAS 57-55-6, by ARCO Chemical Co | 39.25% |
| Sequestrene ® tetrammonium EDTA by BASF Corporation | 30% |
| Poly-Tergent ® SL-62 Surfactant, CAS 68987-81-5 alkoxylated linear alcohol, by BASF Corporation | 15% |
| Tween ® 20 (polysorbate 20), polyoxyethylene (20) Sorbitan monolaurate, CAS 9005-64-5, by ICI Americas, Inc | 10% |
| Isopropyl alcohol, CAS 67-63-0, by Exxon, Shell, Union Carbide or BP Chemicals | 3% |
| Anti-foam Emulsion 7305, non-silicon base by Ashland Chemical Co | 2% |
| 15-Crown-5, CAS 33100-27-5, crown ether by Alfa Aesar | 0.75% |
| Total | 100% |

The above formulation is prepared by mixing each of the ingredients in a vessel. The size of the vessel depends upon the amount of cleaning solution desired.

Example 3

This example is directed to a specific cleaning solution formulation according to the present invention. This cleaning solution is suitable for cleaning low temperature turbines. The identification and amounts of ingredients are as follows:

| Ingredient | Amount (% by weight) |
|---|---|
| Propylene glycol, CAS 57-55-6, by ARCO Chemical Co | 40% |
| Sequestrene ® tetraammonium EDTA by BASF Corporation | 20% |
| Poly-Tergent ® SL-62 Surfactant, CAS 68987-81-5 alkoxylated linear alcohol, by BASF Corporation | 15% |
| Tween ® 20 (polysorbate 20), polyoxyethylene (20) Sorbitan monolaurate, CAS 9005-64-5, by ICI Americas, Inc. | 10% |
| Isopropyl alcohol, CAS 67-63-0, by Exxon, Shell, Union Carbide or BP Chemicals | 3% |
| Methyl Laurate, CAS 111-82-0, By Henkel, Emery 2270 Methyl Laurate | 10% |
| Anti-foam Emulsion 7305, non-silicon base by Ashland Chemical Co | 2% |
| Total | 100% |

The above formulation is prepared by mixing each of the ingredients in a vessel. The size of the vessel depends upon the amount of cleaning solution desired.

Example 4

This example is directed to a specific cleaning solution formulation according to the present invention. This cleaning solution is suitable for cleaning jet engines or other high temperature turbines. The identification and amounts of ingredients are as follows:

| Ingredient | Amount (% by weight) |
|---|---|
| Propylene glycol, CAS 57-55-6, by ARCO Chemical Co | 39.25% |
| Sequestrene ® tetraammonium EDTA by BASF Corporation | 20% |
| Poly-Tergent ® SL-62 Surfactant, CAS 68987-81-5 alkoxylated linear alcohol, by BASF Corporation | 15% |
| Tween ® 20 (polysorbate 20), polyoxyethylene (20) Sorbitan monolaurate, CAS 9005-64-5, by ICI Americas, Inc | 10% |
| Isopropyl alcohol, CAS 67-63-0, by Exxon, Shell, Union Carbide or BP Chemicals | 3% |
| Methyl Laurate, CAS 111-82-0, By Henkel, Emery 2270 Methyl Laurate | 10% |
| Anti-foam Emulsion 7305, non-silicon base by Ashland Chemical Co | 2% |
| 15-Crown-5, CAS 33100-27-5, crown ether by Alfa Aesar | 0.75% |
| Total | 100% |

The above formulation is prepared by mixing each of the ingredients in a vessel. The size of the vessel depends upon the amount of cleaning solution desired.

All cited patents, publications, copending applications, and provisional applications referred to in this application are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A composition comprising:

about 10% to about 60% by weight of a hydroxylated wetting agent, wherein said hydroxylated wetting agent is one or more selected from the group consisting of polypropylene glycol, polyethylene glycol, glycerine, ethylene glycol, and propylene glycol;

about 20% to about 40% by weight of a chelating agent;

about 1% to about 45% by weight of an emulsifier; and about 0.01% to about 2% by weight of a crown ether wherein all % by weight values are based on the total weight of the composition.

2. The composition according to claim 1, comprising:

about 30% to about 50% by weight of said hydroxylated wetting agent;

about 25% to about 35% by weight of said chelating agent;

about 15% to about 35% by weight of said emulsifier; and about 0.05% to about 1.25% by weight of said crown ether, wherein all % by weight values are based on the total weight of the composition.

3. The composition according to claim 2, comprising:

about 38% to about 42% by weight of said hydroxylated wetting agent;

about 29% to about 31% by weight of said chelating agent;

about 20% to about 30% by weight of said emulsifier; and about 0.5% to about 1% by weight of said crown ether, wherein all % by weight values are based on the total weight of the composition.

4. The composition according to claim 1, wherein said hydroxylated wetting agent is a hydroxylated hydrocarbon containing 2 to 6 carbon atoms and 2 to 4 hydroxyl groups.

5. The composition according to claim 4, wherein the ratio of said carbon atoms to said hydroxyl groups is between 1.0 and 0.75.

6. The composition according to claim 1, wherein said chelating agent is a derivative of EDTA.

7. The composition according to claim 1, wherein said emulsifier is a non-ionic surfactant.

8. The composition according to claim 1, wherein said crown ether is a $C_8$–$C_{30}$ crown ether.

9. The composition according to claim 8, wherein said crown ether is a $C_{10}$–$C_{20}$ crown ether.

10. The composition according to claim 9, wherein said crown ether is a $C_{13}$–$C_{19}$ crown ether.

11. The composition according to claim 1, further comprising a water-soluble organic solvent and a non-silicon based anti-foam agent.

12. The composition according to claim 11, wherein said water-soluble organic solvent is isopropanol and said anti-foam agent is an ethoxylated linear alcohol.

13. The composition according to claim 1, wherein said composition is 100% biodegradable.

14. The composition according to claim 1, wherein said composition removes particles having a particle size of less than 35 micrometers when said composition is applied to a gas turbine.

15. A process for cleaning a substrate, comprising:

providing the composition according to claim 1; and contacting said composition with said substrate for an amount of time sufficient to clean said substrate.

16. The process according to claim 15, wherein said substrate is a gas turbine engine.

17. The composition of claim 1, further comprising a non-aromatic solvent.

18. The composition according to claim 17, comprising:

about 10% to about 60% by weight of said hydroxylated wetting agent;

about 1% to about 30% by weight of said chelating agent;

about 1% to about 45% by weight of said emulsifier;

about 0.01% to about 2% by weight of said crown ether; and about 1% to about 20% by weight of said non-aromatic solvent, wherein all % by weight values are based on the total weight of the composition.

19. The composition according to claim 18, comprising:

about 30% to about 50% by weight of said hydroxylated wetting agent;

about 15% to about 25% by weight of said chelating agent;

about 15% to about 35% by weight of said emulsifier;

about 0.05% to about 1.25% by weight of said crown ether; and about 5% to about 15% by weight of said non-aromatic solvent, wherein all % by weight values are based on the total weight of the composition.

20. The composition according to claim 19, comprising:

about 38% to about 42% by weight of said hydroxylated wetting agent;

about 19% to about 21% by weight of said chelating agent;

about 20% to about 30% by weight of said emulsifier;

about 0.5% to about 1% by weight of said crown ether; and about 9% to about 11% by weight of said non-aromatic solvent, wherein all % by weight values are based on the total weight of the composition.

21. The composition according to claim 17, wherein said non-aromatic solvent is selected from the group consisting of (1) a linear or non-linear alcohol having 1 to 6 carbons and from 1 to 5 ethoxylations, (2) a mono-, di-, or tri-ester of mono-, di-, or tri-carboxylic acid, and (3) a mono-, di-, or tri-alkyl ester.

22. The composition according to claim 21, wherein said non-aromatic solvent is selected from the group consisting of methyl ester, ethyl ester, ethyl acetate, methyl laurate, dimethyl citric acid, ethyl propionate, lauryl acetate, methyl glutamate, diethoxy-2-ethyl propyl alcohol, diethoxy pentyl alcohol, triethoxy pentyl alcohol, and diethoxylated isobutyl alcohol.

23. The composition according to claim 21, wherein said non-aromatic solvent is an ethoxylated non-linear alcohol or an organic ester.

24. The composition according to claim 23, wherein said ethoxylated non-linear alcohol is di-ethoxylated isobutyl alcohol, and said organic ester is methyl laurate.

25. The composition according to claim 1, wherein said hydroxylated wetting agent is one or more selected from the group consisting of glycerine, ethylene glycol, and propylene glycol.

* * * * *